US008525425B1

(12) United States Patent
Roudeski

(10) Patent No.: US 8,525,425 B1
(45) Date of Patent: Sep. 3, 2013

(54) LED LIGHTING SYSTEM

(76) Inventor: Charles A. Roudeski, Springfield, OH (US)

( * ) Notice: Subject to any disclaimer, the term of this patent is extended or adjusted under 35 U.S.C. 154(b) by 0 days.

(21) Appl. No.: 13/331,780

(22) Filed: Dec. 20, 2011

Related U.S. Application Data

(60) Provisional application No. 61/425,492, filed on Dec. 21, 2010.

(51) Int. Cl.
*H05B 37/00* (2006.01)

(52) U.S. Cl.
USPC ..... 315/188; 315/185 R; 315/185 S; 315/192; 315/291; 315/294

(58) Field of Classification Search
USPC ..... 315/185 S, 185 R, 188, 192, 291, 315/294
See application file for complete search history.

(56) References Cited

U.S. PATENT DOCUMENTS

| | | | | |
|---|---|---|---|---|
| 5,338,991 | A * | 8/1994 | Lu | 327/455 |
| 6,551,345 | B2 * | 4/2003 | Vogel et al. | 607/1 |
| 2009/0261743 | A1 * | 10/2009 | Chen et al. | 315/192 |
| 2010/0060182 | A1 * | 3/2010 | Stack | 315/228 |
| 2012/0001568 | A1 * | 1/2012 | Lee et al. | 315/294 |

* cited by examiner

*Primary Examiner* — Douglas W Owens
*Assistant Examiner* — Thai Pham
(74) *Attorney, Agent, or Firm* — James R. Eley; Michael A. Forhan; Eley Law Firm Co. LPA

(57) ABSTRACT

An LED lighting system has an LED circuit that includes a first LED having an anode and a cathode, and a second LED having an anode and a cathode. The anode of the second LED is electrically coupled to the cathode of the first LED, and the cathode of the second LED is electrically coupled to the anode of the first LED. The first and second LEDs are in an inverse-parallel arrangement, the first LED acting as a reverse-voltage clamp for the second LED and the second LED acting as a reverse-voltage clamp for the first LED.

14 Claims, 5 Drawing Sheets

LED LIGHTING SYSTEM

This application claims priority to U.S. provisional application 61/425,492, filed Dec. 21, 2010, the contents of which are hereby incorporated by reference.

FIELD

The present invention relates generally to lighting systems, in particular to lighting systems utilizing light emitting diodes.

BACKGROUND

Although light emitting diodes (LEDs) promise long operating life, their static-sensitive nature makes them susceptible to lightning-induced failures. This becomes a significant reliability issue for LEDs used in obstruction warning lights, which may be struck by lightning up to ten or more times a year.

Another reliability concern with respect to LEDs arises when they are electrically connected together in a series network. From an engineering standpoint electrically connecting LEDs in a series network string is desirable since all of the LEDs in the network have the same operating current, thus providing relatively uniform brightness throughout the string of LEDs. One disadvantage, however, is that if just one LED fails open-circuit due to lightning damage, a broken bond wire, a cold solder joint or a bad connection, for example, all of the remaining LEDs in the string will turn off even if they are in operable condition. To overcome this drawback, a "bypass shunt" device such as a zener diode, silicon-controlled rectifier (SCR) or "anti-fuse" is sometimes used in parallel with each LED. Accordingly, if an LED fails open-circuit, a resultant rise in voltage across electrical terminals of the failed LED turns on the bypass shunt device, thereby routing electrical current around the open circuit so that the remaining LEDs in the string that are in operable condition will illuminate.

An example bypass shunt arrangement is shown in FIG. 1. A string or network 10 comprises a plurality of LEDs 12 that are electrically connected in series and are powered by an electrical power supply 14 connected in parallel with the network. Each LED 12 includes a zener diode 16 bypass shunt connected in parallel therewith, the zener diode being reverse-biased with respect to power supply 14. Zener diodes 16 are each configured to have a reverse breakdown voltage that is slightly greater than the forward voltage of a corresponding LED 12, so the zener diode normally remains in a non-conducting or "off" state. However, if an LED 12 fails in an open-circuit state a voltage greater than the reverse breakdown voltage rating of the associated parallel-connected zener diode 16 is present at the terminals of the zener diode, causing it to begin conducting (i.e., switch to an "on" state) so that current supplied by the power supply is maintained in LED series network 10.

A drawback of this arrangement is that, in its conducting state, the electrical power dissipated by zener diode 16 is higher than that of the operational, unshunted LEDs 12. Consequently, heat dissipation considerations must be made for an electronic circuit assembly containing zener diodes 16, such as a printed wiring board assembly, taking into account the potential for a plurality of zener diodes being in a conducting state and dissipating heat at any given time. In addition, zener diodes 16 are physically relatively large devices and thus typically require a significant amount of space on the aforementioned electronic assembly.

With reference to FIG. 2, a more complex string or network 20 comprises a plurality of LEDs 12 electrically connected in series and powered by power supply 14, which is connected in parallel with the network. Each LED 12 includes a silicon controlled rectifier (SCR) 22 bypass shunt connected in parallel therewith. A voltage-sense circuit such as a trigger zener diode 24 or, alternatively, a resistive divider network (not shown) is configured to sense a voltage increase at the electrical terminals of an associated LED 12 when the LED fails to an open-circuit condition and trigger the corresponding SCR to a latched, conducting state. When the triggered SCR 22 is thus latched in its conducting state the voltage drop across its electrical terminals is much lower than the voltage drop of zener diode 16 of FIG. 1 (typically on the order of about 0.8-1.0 Volts) so there is relatively little heat dissipation, even for conditions where somewhat high currents are present in LED string 20. To unlatch the triggered SCR 22 and return it to its non-conducting state the current of LED string 20 must be reduced to a level below the rated holding current for the SCR. Alternatively, the power supplied to LED string 20 by power supply 14 may be momentarily interrupted to return SCR 22 to its non-conducting state. Unlatching a triggered SCR 22 may desirable for situations where an associated LED 12 autonomously resolves its fault, thereby allowing the LED to illuminate.

With reference to FIG. 3 a string or network 30 comprises a plurality of LEDs 12 electrically connected in series and powered by power supply 14, which is connected in parallel with the network. Each LED 12 includes an "anti-fuse" device 32 connected in parallel therewith. Anti-fuse 32 is available from, for example, Murata Electronics North America of Smyrna, Ga. Anti-fuse 32 changes from an off-state resistance of several megohms to an "on" or conducting state having a resistance of a few ohms when the voltage at terminals of the anti-fuse exceeds a predetermined level. Like SCR 22 of FIG. 2, anti-fuse 32 dissipates relatively little power when in a conducting state. However, its relatively small size limits its current-handling capability. In addition, unlike zener diode 16 of FIG. 1 and SCR 22 of FIG. 2, the resistance change of anti-fuse 32 is permanent once placed into a conducting state. Thus, even if a failed LED 12 autonomously resolves its fault the LED will remain bypassed by the associated anti-fuse 32. Furthermore, if an open-circuit failed LED 12 must be replaced, the corresponding anti-fuse 32 shunt must also be replaced, increasing maintenance labor and component expense.

As can be appreciated from the foregoing, although the present art has made some advances in the protection of LEDs in order to increase the overall reliability of LED lighting systems in which they are installed, there remains a need to better protect LEDs that are subject to high voltages due to electrostatic discharge and lightning strikes. This need is particularly great for LEDs that are remotely located or are otherwise relatively inaccessible, such as LEDs used in obstruction lighting.

SUMMARY

The present invention provides a means for protecting a plurality of LEDs while also improving LED lighting system fault tolerance. In addition, accurate and robust monitoring circuitry may be provided to detect and identify failed LEDs.

In one embodiment of the present invention a simplified interconnection of LEDs results in a reduction in the complexity of associated monitoring circuitry. LEDs are also protected from damage by their arrangement with respect to each other. In addition, shunt bypass devices may be employed to provide active protection during fast-rising lightning pulses, even with power removed from the LEDs.

An object of the present invention is an LED lighting system. The lighting system has an LED circuit that includes a first LED having an anode and a cathode, and a second LED having an anode and a cathode. The anode of the second LED is electrically coupled to the cathode of the first LED, and the cathode of the second LED is electrically coupled to the anode of the first LED. The first and second LEDs are in an inverse-parallel arrangement, the first LED acting as a reverse-voltage clamp for the second LED and the second LED acting as a reverse-voltage clamp for the first LED.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
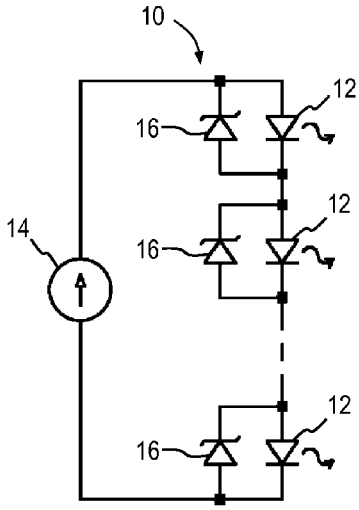
Fig. 1 PRIOR ART
FIG. 1 is a schematic diagram of a prior art LED fault-bypass shunt circuit utilizing zener diodes.
Figure 2:
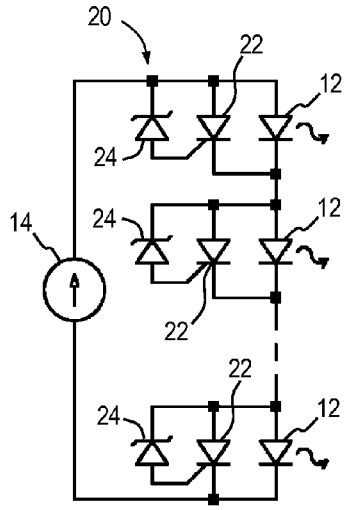
Fig. 2 PRIOR ART
FIG. 2 is a schematic diagram of a prior art LED fault-bypass shunt circuit utilizing silicon controlled rectifiers.
Figure 3:
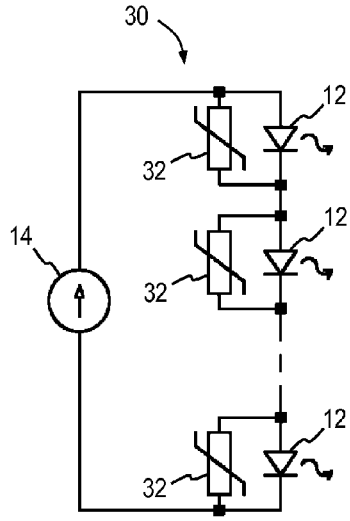
Fig. 3 PRIOR ART
FIG. 3 is a schematic diagram of a prior art LED fault-bypass shunt circuit utilizing anti-fuses.

In the discussion that follows, like reference numerals are used to refer to like elements and structures in the various figures.

Figure 4:
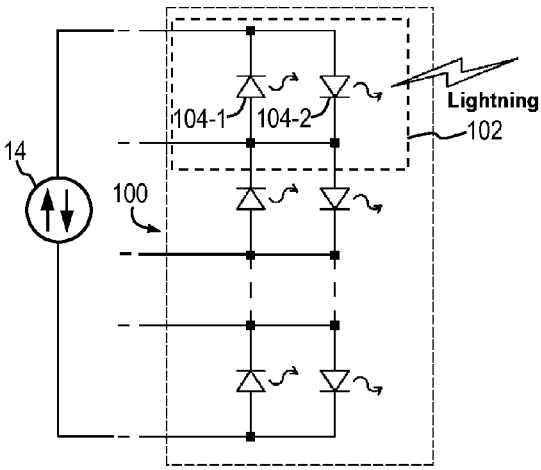
FIG. 4 is a schematic diagram of an LED circuit utilizing LEDs in an inverse-parallel arrangement according to an embodiment of the present invention.

Referring now to FIG. 4, the general arrangement of an LED network 100 is shown according to a preferred embodiment of the present invention. Network 100 comprises an LED circuit 102 that includes a paired arrangement of two LEDs 104. A first and a second LED 104-1, 104-2 respectively, each have an anode and a cathode. The anode of the second LED 104-2 is electrically coupled to the cathode of the first LED 104-1, the cathode of the second LED being electrically coupled to the anode of the first LED. The first and second LEDs 104-1, 104-2 respectively are in an inverse-parallel arrangement, and may be wired in a series-network arrangement with additional LED circuits 102 as shown in FIG. 4.

In the arrangement of FIG. 4 the forward-voltage drop (typically on the order of about 1.8-3.8 volts) of each LED 104 is less than its reverse-voltage rating (typically on the order of about 5 volts). Accordingly, in LED circuit 102 each LED 104 of the pair acts as a reverse-voltage clamp for the other, regardless of the polarity of the voltage applied to the LED circuit by power supply 14, since one of the pair of LEDs will always be forward-biased. This reduces the risk of damage to the LEDs 104 due to exposure to electrostatic discharge (ESD) and lightning strikes.

Figure 5:
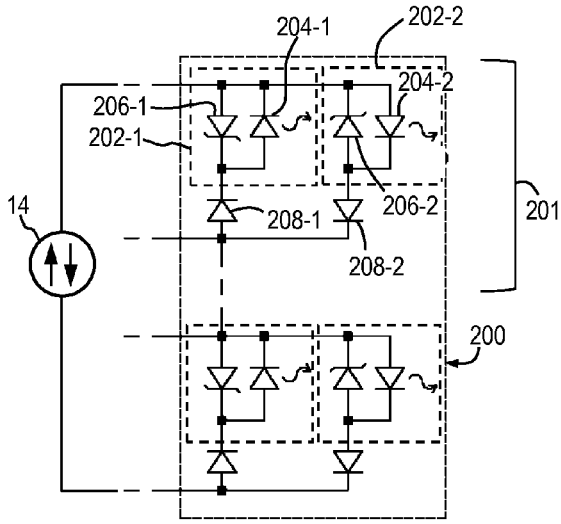
FIG. 5 is a schematic diagram of an LED circuit utilizing zenered LEDs according to another embodiment of the present invention.

Some LEDs do not have a reverse voltage rating, but may include a zener diode internal or external to the package of the LED and electrically coupled in parallel with the LED. Although typically not capable of open-circuit shunting, an internal zener diode does provide some ESD protection. The general arrangement of an LED network 200 having LED packages 202-1 and 202-2 with internal zener diodes is shown in FIG. 5. Each LED package 202 includes an LED 204 and a zener diode 206.

With continued reference to FIG. 5, an LED circuit 201 includes a first zener diode 206-1 that is electrically coupled to a first LED 204-1, the anode of the first zener diode being electrically coupled to the cathode of the first LED and the cathode of the first zener diode being electrically coupled to the anode of the first LED. Similarly, a second zener diode, 206-2, is electrically coupled to a second LED, 204-2, the anode of the second zener diode being electrically coupled to the cathode of the second LED and the cathode of the second zener diode being electrically coupled to the anode of the second LED. A cathode of a first blocking diode 208-1 is electrically coupled to the anode of the first LED 204. An anode of a second blocking diode 208-2 is electrically coupled to the cathode of the second LED 204-2, while the cathode of the second blocking diode is electrically coupled to the anode of the first blocking diode 208. LED circuit 201 may be wired in a series-network arrangement with additional LED circuits 201, as shown in FIG. 5.

In the network 200 of FIG. 5 blocking diode 208 is added to each LED 204 to prevent current from flowing though the zener diode 206 of the other LED in the inverse parallel arrangement of network 200. Without blocking diodes 208, neither of the LEDs 204 in the inverse parallel arrangement of network 200 would light because the forward voltage of zener diodes 206 is much lower than that of the LEDs' forward voltage. Other arrangements are possible within the scope of the invention such as, but not limited to, using integrated multi-diode packages to conserve space.

Figure 6:
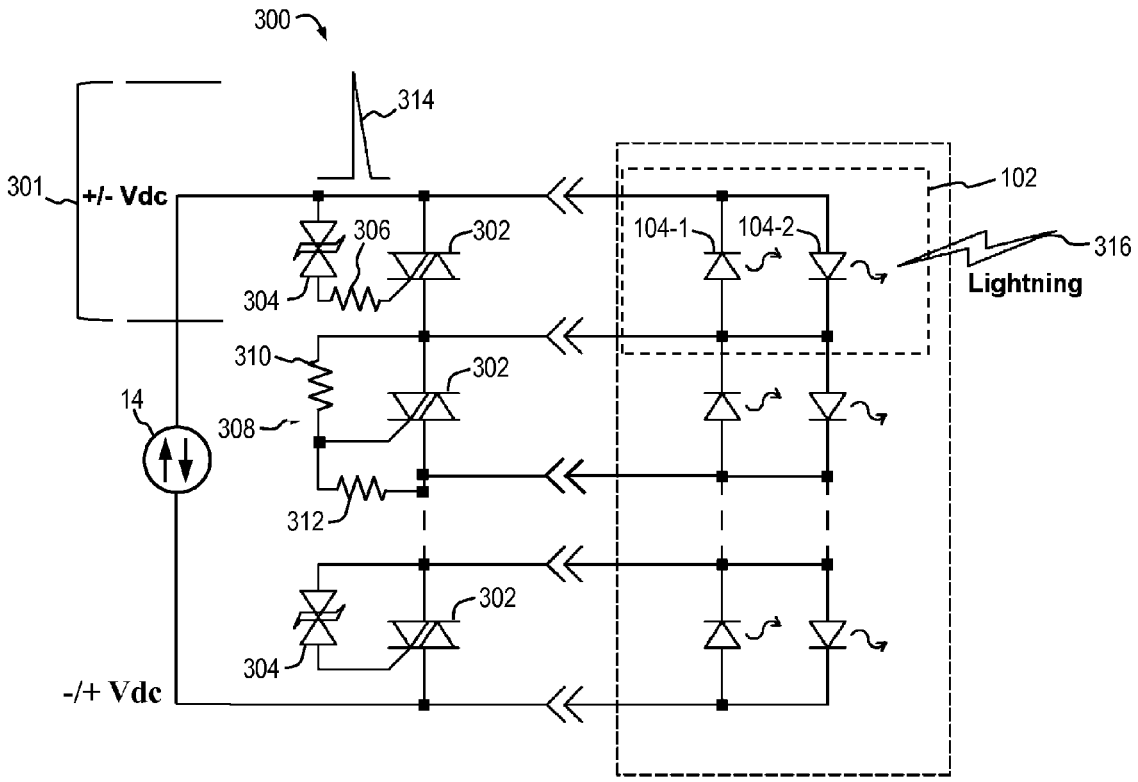
FIG. 6 is a schematic diagram of an LED circuit utilizing the arrangement of FIG. 4 in combination with a triac LED fault-shunt bypass circuit according to yet another embodiment of the present invention.

By combining the inverse-parallel LED arrangement of FIG. 4 with a bidirectional shunt device, the number of shunt devices may be effectively halved. FIG. 6 shows an LED network 300 utilizing a triac 302 and a low-voltage transient voltage suppressor (TVS) diode 304 connected across each LED circuit 102.

An LED circuit 301 includes an LED circuit 102 having a first and a second LED 104 wired in an inverse-parallel arrangement in the manner previously described in FIG. 4. A triac 302 has a first triac anode, a second triac anode, and a gate, the first triac anode being electrically coupled to the cathode of first LED 104-1 and the second triac anode being electrically coupled to the anode of the first LED. A transient voltage suppressor 304 has a first suppressor anode and a second suppressor anode, the first suppressor anode being electrically coupled to the first triac anode of triac 302 and the second suppressor anode being electrically coupled to the gate of the triac. Triac 302 is latched to a conducting state in the event first LED 104-1 fails to an open electrical circuit while in a conducting (i.e., operating) state. Likewise, triac 302 is latched to a conducting state in the event second LED 104-2 fails to an open electrical circuit while in a conducting (i.e., operating) state. LED circuit 301 may be wired in a series-network arrangement with additional LED circuits, as shown in FIG. 6.

As also shown in FIG. 6, the addition of an optional gate resistor 306 may be desirable for LED circuits 300 having higher LED currents, although gate dissipation is eliminated by the turn on of the triac 302. Alternatively, a resistive divider 308 comprising a pair of resistors 310, 312 (FIG. 6) may be used in place of TVS diode 304, with or without gate resistor 306, if voltage threshold variability is not a concern.

In operation of LED circuit 300, in the event that an operating LED 104 fails and develops an open electrical circuit, a rising voltage across the electrical terminals of the failed LED is coupled to the gate of an associated triac 302, latching the triac from a non-conducting state to a conducting state, typically within about 1 μs. In the conducting state triac 302 heat dissipation is relatively low due to its inherently low voltage drop. Accordingly, a triac 302 having a relatively low power rating and smaller physical size may be selected. Note that reversal of the voltage/current provided by power supply 14 to LED network 300 will cause the conducting triac 302 to switch to a non-conducting state, allowing the LED 104 in inverse-parallel with the failed LED to illuminate. In one embodiment of the present invention the drive current supplied to LED network 300 may be periodically interrupted to unlatch any conducting triacs 302, thereby allowing any associated LEDs 104 that have autonomously cleared an internal fault an opportunity to light again. This interruption is inherent with flashing beacons but may also be automatically or manually incorporated into steady-burning lights to affirmatively clear such faults.

Under some conditions triacs 302 of FIG. 6 may be placed into a conducting state spontaneously (even with power to LED network 300 removed) as a result of relatively high dV/dt electrical pulses 314 induced during lightning strikes 316. In this case, the triac 302 in a conducting state acts to shunt potentially damaging energy away from the LEDs 104 until the drive voltage/current is momentarily interrupted in the manner previously described.

Figure 7:
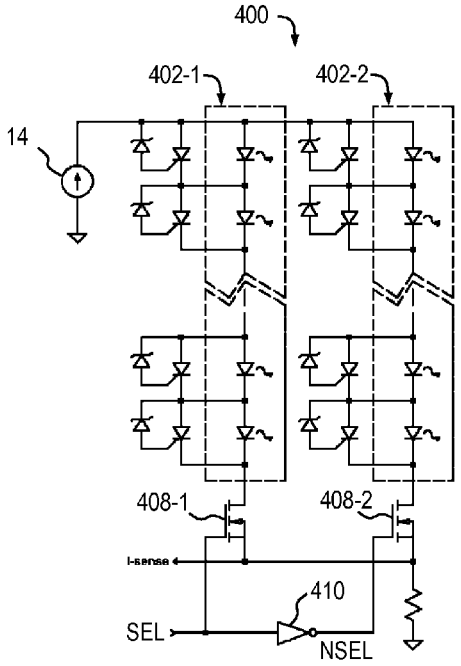
Fig. 7 PRIOR ART
FIG. 7 is a schematic diagram of two selectable LED banks in a prior art LED system utilizing silicon controlled rectifiers.

In some embodiments it may be desirable to select between a plurality of shunted LED circuit strings. FIG. 7 shows the basic circuitry for a prior art LED network 400. A first LED string 402-1 and a second LED string 402-2 are each isolated from a power supply 14 by first and second corresponding switches 408-1, 408-2 respectively. A binary control signal, labeled SEL, is coupled to first switch 408-1. Control signal SEL is logically inverted by an inverter 410 to produce an inverse-logic control signal NSEL that is coupled to second switch 408-2. In operation, only one of LED strings 402-1, 402-2 is in an on-state (i.e., illuminated) at any given time, first string 402-1 being in an on-state when SEL is a logical "1" and second string 402-2 being in an on-state when SEL is a logical "0." LED strings 402-1, 402-2 may each be configured as any of the LED circuits, networks and shunt bypass circuits shown in FIGS. 1 through 6 and discussed above, within the scope of the invention.

Figure 8:
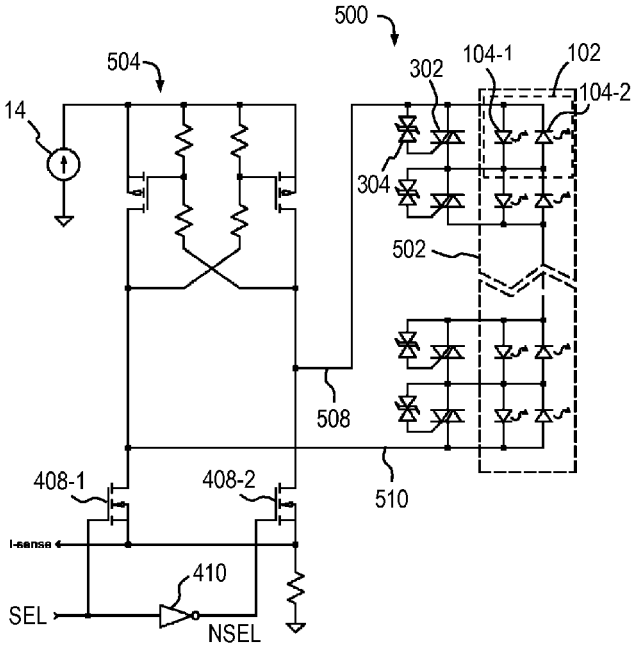
FIG. 8 is a schematic diagram of two selectable LED banks in an LED lighting system utilizing shared triacs and connections according to another embodiment of the present invention.

FIG. 8 shows an LED network 500 that achieves similar functionality to circuit 400 of FIG. 7. A string 502 of LEDs 104 are connected in the inverse-parallel LED circuit 102 arrangement of FIG. 4 with the addition of triac shunts, as in FIG. 6. An H-bridge 504 controls the polarity of power supplied to LED pairs 102 by power supply 14, the polarity in turn being controlled by a binary control signal SEL, a pair of switches 408 and an inverter 410 in the manner described above. H-bridge circuit 504 has a first output 508 and a second output 510, the first and second outputs each being selectably configurable as a current source and a current sink. First output 504 is a current source when second output 510 is configured as a current sink. Likewise, second output 510 is configured as a current source when first output 508 is configured as a current sink. Of course, other functionally similar H-bridge configurations are possible within the scope of the present invention.

It can be seen from FIG. 8 that, by reversing the polarity applied to the LED string 502, either of the LEDs 104 in LED circuit 102 may be selectively energized. LED circuits 102 may find application in beacons that flash white during the day and red at night, LED 104-1 being a white LED and LED-2 being a red LED (or vice versa). In other embodiments LED 104-2 may serve as a back-up for LED 104-1 (or vice versa). Another practical application includes, but is not limited to, selectably energizing LEDs in different areas of a reflector or lens of an optic portion of an LED lighting system to achieve a flood or spotlight beam pattern.

By grouping the LEDs inverse parallel arrangements 102 described above the number of interconnections are reduced. This is important in applications, for example, where the LED light panels are socketed. Should a socket contact fail, for example, the shunt device will bypass the open circuit, and may automatically recover if power is removed or the other LED string is selected. It will be further appreciated by one skilled in the art that any of the LED circuits, networks and shunt bypass circuits of FIGS. 1 through 6 may be adapted for use with LED network 500 of FIG. 8, within the scope of the invention.

Safety-related applications may be subject to governmental regulations and require the monitoring of LEDs, and to issue a remote alert signal for a service call, or take other predetermined remedial action if a certain percentage or pattern of LEDs fail. One failure detection scheme is to divide the LEDs into small groups, each with its own linear current regulator, and monitor each group's voltage. A drawback of such arrangements is relatively low efficiency, coupled with relatively complex circuitry. In addition, current matching between LED groups can be difficult to achieve.

Figure 9:
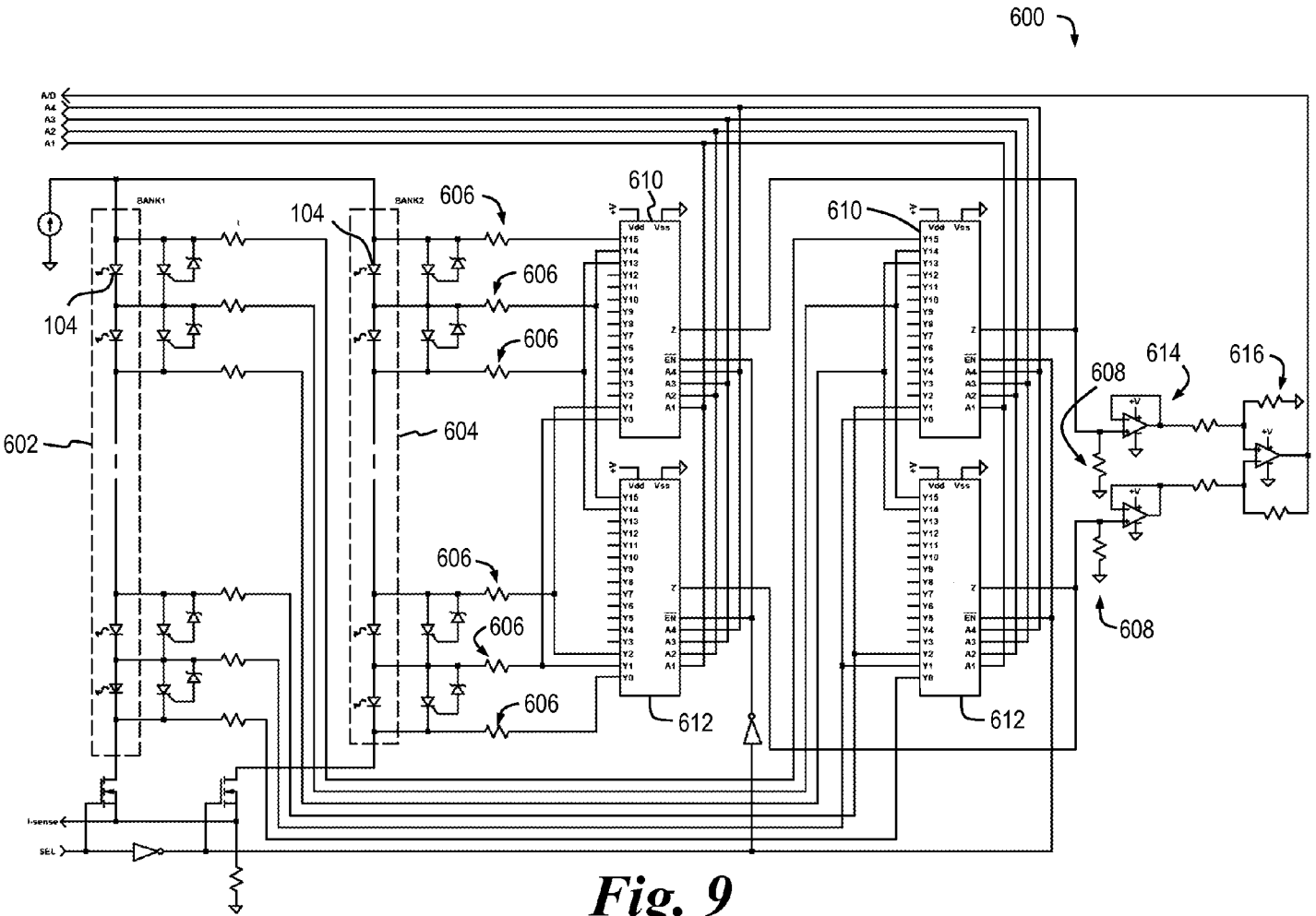
Fig. 9 PRIOR ART
FIG. 9 is a schematic diagram of two selectable LED banks with monitoring capability in a prior art LED lighting system.

In a prior art LED circuit 600 shown in FIG. 9, LEDs 104 are connected in series, forming LED strings 602 and 604. The LED 104 voltages are scanned and compared to a reference voltage as follows. Voltage dividers comprising resistors 606 and 608 are used to scale the LED 104 voltages with respect to electrical ground. A first analog multiplexer 610 is used to select an LED's "high" side and a second multiplexer 612 to select that LED's "low" side. The two signals are then applied to a differential amplifier circuit 614, 616 with a gain equal to the resistive dividers' scaling factor (for example), the resulting voltage being equivalent to the forward voltage of the select LED 104. Other gain/ratios may be utilized to accommodate variables such as circuitry having limited voltage range, for example. This signal may then be examined by a not-shown window comparator or a not-shown microcontroller analog-to-digital (A/D) input to monitor the forward voltage of the LEDs and determine if a selected LED's voltage is too high or too low, indicating an open-circuit or short-circuit respectively in the select LED. It should be noted that the thresholds may need to be adjusted if the LEDs in each string are different.

Figure 10:
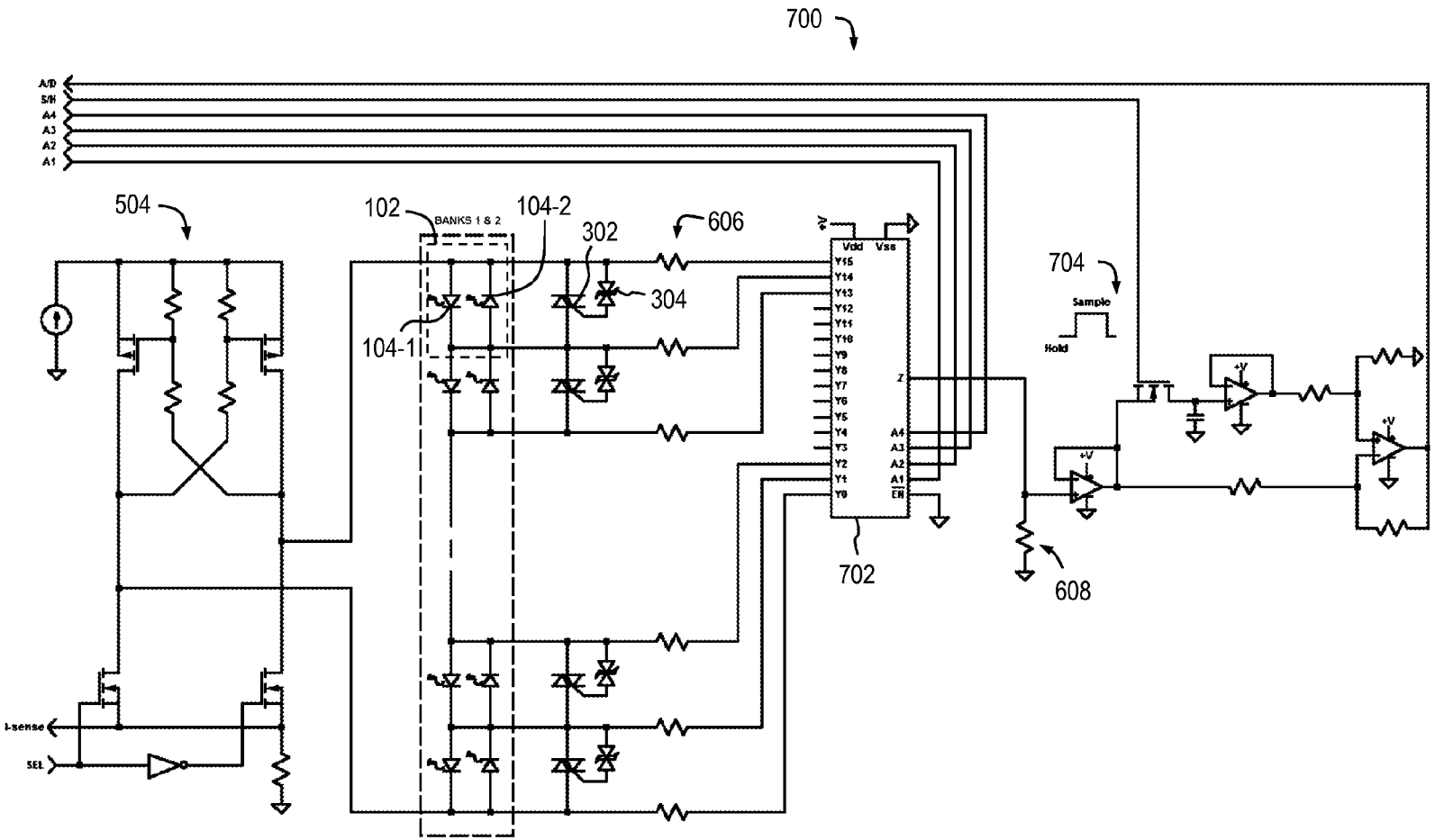
FIG. 10 is a schematic diagram of two selectable LED banks with monitoring capability in an LED lighting system according to still another embodiment of the present invention.

An LED circuit 700 is shown in FIG. 10 according to an embodiment of the present invention. As previously discussed, the inverse-parallel arrangement of LED pairs 102 halves the number of bypass devices needed for open-circuit protection. Similarly, the number of voltage dividers and multiplexers for LED pair 102 monitoring is halved in comparison to the prior art circuit of FIG. 9. Additional simplification is realized by time-sharing an analog multiplexer such that the two differential voltages are derived from a sample-hold signal from the previous LED's voltage and the next LED's voltage obtained in real-time. It should be noted that the sample-hold and differential function are optional, since associated monitoring circuitry may be configured to evaluate the voltages directly by storing the first reading and subtracting the second, assuming quantization error and RF susceptibility are not a concern. In this manner the requisite number of multiplexers is halved yet again. As can be seen from comparing FIGS. 9 and 10, LED circuit 700 of the present invention is much less complex, thereby reducing cost while increasing reliability. In some embodiments a microprocessor may be utilized to evaluate the LEDs by going from a higher voltage to a lower voltage, providing a "sample" command at an appropriate time after currents have settled, and realizing that reversing the string voltage also requires reversing the direction of the scan sequence. Scanning from a lower to a higher voltage may also be accomplished using an analog sample gate, provided the differential amplifier inputs are reversed.

With continued reference to FIG. 10, a single analog multiplexer 702 has a plurality of input channels and an output channel, the input channels being electrically coupled to the LED circuits 102 and configured to receive at a select input channel a voltage representing the voltage between the anode and the cathode of the LEDs of the LED circuit. A sample-and-hold circuit 704 is coupled to the output channel of multiplexer 702, the sample-and-hold circuit selectably storing a voltage measured at the select input channel for a select LED circuit 102. Sample-and-hold circuit 704 may be configured to store one voltage point measurement and compare it to the next to determine the voltage drop for each LED. It should also be readily apparent to one skilled in the art that an open-circuited LED 104 will appear shorted while its associated shunt device is in a conducting state; thus, it is still considered a failed LED.

It should be noted that LED circuits 102 are shown in FIG. 10 as examples, and that any of the LED circuits, networks and shunt bypass circuits of FIGS. 1 through 6 may be adapted for use with the system of FIG. 10, within the scope of the invention. In addition, one skilled in the art will appreciate that the system of FIG. 10 may be configured and replicated to monitor any desired number of LED strings in an LED lighting system, within the scope of the invention.

The system of FIG. 10 may also be configured to further include the previously-described H-bridge 504, as shown.

With regard to the LED lighting system of FIG. 10 a microcontroller (not shown) may be advantageous for individual LED monitoring. In this instance the number of LEDs can be measured and action taken when a certain percentage of LEDs have failed or perhaps a certain group; i.e., all or most LEDs oriented in a single direction.

While this invention has been shown and described with respect to a detailed embodiment thereof, it will be understood by those skilled in the art that changes in form and detail thereof may be made without departing from the scope of the claims of the invention.

What is claimed is:

1. An LED lighting system, comprising:

an LED circuit including:

a first LED having an anode and a cathode;

a second LED having an anode and a cathode, the anode of the second LED being electrically coupled to the cathode of the first LED, the cathode of the second LED being electrically coupled to the anode of the first LED, the first and second LEDs being in an inverse-parallel arrangement, the first LED acting as a reverse-voltage clamp for the second LED, and the second LED acting as a reverse-voltage clamp for the first LED; and a triac having a first triac anode, a second triac anode and a gate, the first triac anode being electrically coupled to the cathode of the first LED and the second triac anode being electrically coupled to the anode of the first LED; and a transient voltage suppressor having a first suppressor anode and a second suppressor anode, the first suppressor anode being electrically coupled to the first triac anode and the second suppressor anode being electrically coupled to the gate of the triac, the triac being latched to a conducting state in the event the first LED fails in an open electrical circuit while in a conducting state, and the triac being latched to a conducting state in the event the second LED fails in an open electrical circuit while in a conducting state.

2. The LED lighting system of claim 1, further including a plurality of LED circuits, the LED circuits being electrically coupled together in a series-network arrangement.

3. The LED lighting system of claim 1, further including:

a first zener diode electrically coupled to the first LED, the first zener diode having an anode and a cathode, the anode of the first zener diode being electrically coupled to the cathode of the first LED and the cathode of the first zener diode being electrically coupled to the anode of the first LED;

a second zener diode electrically coupled to the second LED, the second zener diode having an anode and a cathode, the anode of the second zener diode being electrically coupled to the cathode of the second LED and the cathode of the second zener diode being electrically coupled to the anode of the second LED;

a first blocking diode having an anode and a cathode, the cathode of the first blocking diode being electrically coupled to the anode of the first LED; and a second blocking diode having an anode and a cathode, the anode of the second blocking diode being electrically coupled to the cathode of the second LED and the cathode of the second blocking diode being electrically coupled to the anode of the first blocking diode.

4. The LED lighting system of claim 3, wherein:

the first LED and the first zener diode are integrated together into a first package; and the second LED and the second zener diode are integrated together into a second package.

5. The LED lighting system of claim 3, wherein the first LED, second LED, first zener diode and second zener diode are each contained in separate packages.

6. The LED lighting system of claim 3, further comprising a plurality of LED circuits, the LED circuits being electrically coupled together in a series-network arrangement.

7. The LED lighting system of claim 1, further comprising a plurality of LED circuits, the LED circuits being electrically coupled together in a series-network arrangement.

8. The LED lighting system of claim 1, further including a gate resistor intermediate the second suppressor anode of the transient voltage suppressor and the gate of the triac.

9. The LED lighting system of claim 1, further including;

a first resistor, a first terminal of the first resistor being electrically coupled to the first anode of the triac and a second terminal of the first resistor being electrically coupled to the gate of the triac; and a second resistor, a first terminal of the second resistor being electrically coupled to the gate of the triac and a second terminal of the second resistor being electrically coupled to the second anode of the triac.

10. The LED lighting system of claim 1, further including:

an H-bridge circuit having a first output and a second output, the first and second outputs each being selectably configurable as a current source and a current sink, the first output being configured as a current source when the second output is configured as a current sink, the second output being configured as a current source when the first output is configured as a current sink, and the first and second outputs of the H-bridge being electrically coupled to the LED circuit.

11. The LED lighting system of claim 1, further including:

an analog multiplexer circuit having a plurality of input channels and an output channel, the analog multiplexer circuit being electrically coupled to the LED circuit and configured to receive at a select input channel a voltage representing the voltage between the anode and the cathode of the LEDs of the LED circuit; and a sample-and-hold circuit coupled to the output channel of the multiplexer, the sample-and-hold circuit selectably storing a voltage measured at the select input channel.

12. The LED lighting system of claim 11, further comprising:

a plurality of LED circuits, the LED circuits being electrically coupled together in a series-network arrangement, each of the LED circuits being electrically coupled to at least one of the plurality of input channels of the multiplexer, the multiplexer being configured to selectably receive from each of the LED circuits a voltage representing the voltage between the anode and the cathode of the LEDs of the LED circuits.

13. The LED lighting system of claim 11, further including:

an H-bridge circuit having a first output and a second output, the first and second outputs each being selectably configurable as a current source and a current sink, the first output being configured as a current source when the second output is configured as a current sink, the second output being configured as a current source when the first output is configured as a current sink, and the first and second outputs of the H-bridge being electrically coupled to the LED circuit.

14. The LED lighting system of claim 1, further including:

a first plurality of LED circuits electrically coupled to the first LED circuit, the first LED circuit and said first plurality of LED circuits being electrically coupled together in a series-network arrangement; and a second plurality of LED circuits electrically coupled to the second LED circuit, the second LED circuit and said second plurality of LED circuits being electrically coupled together in a series-network arrangement.

* * * * *

UNITED STATES PATENT AND TRADEMARK OFFICE

CERTIFICATE OF CORRECTION

PATENT NO. : 8,525,425 B1
APPLICATION NO. : 13/331780
DATED : September 3, 2013
INVENTOR(S) : Charles A. Roudeski It is certified that error appears in the above-identified patent and that said Letters Patent is hereby corrected as shown below:

On the title page, "(76) Inventor:" should read --(75) Inventor:--

The title page should include --(73) Assignee: Hughey & Phillips, LLC, Urbana, OH (US)--

Signed and Sealed this
Twenty-eighth Day of January, 2014

Michelle K. Lee

Michelle K. Lee
*Deputy Director of the United States Patent and Trademark Office*